US007843338B2

(12) United States Patent
Zhou et al.

(10) Patent No.: US 7,843,338 B2
(45) Date of Patent: Nov. 30, 2010

(54) SAFETY LINING, A SAFETY ALARMING SYSTEM PROVIDED WITH THE SAME, A LOGISTIC VESSEL WITH SAFETY ALARMING SYSTEM, AND A METHOD FOR IMPROVING SAFETY OF THE LOGISTIC VESSEL

(75) Inventors: Yuanda Zhou, Guangdong (CN); Shouqin Zhou, Guangdong (CN); Tao Peng, Guangdong (CN)

(73) Assignee: China International Marine Containers (Group) Co., Ltd., Shenzhen, Guangdong (CN)

( * ) Notice: Subject to any disclaimer, the term of this patent is extended or adjusted under 35 U.S.C. 154(b) by 327 days.

(21) Appl. No.: 11/893,510

(22) Filed: Aug. 16, 2007

(65) Prior Publication Data

US 2008/0042833 A1 Feb. 21, 2008

(30) Foreign Application Priority Data

Aug. 21, 2006 (CN) ..... 2006 1 0112491

(51) Int. Cl.
*G08B 13/00* (2006.01)

(52) U.S. Cl. ..... 340/550

(58) Field of Classification Search ..... 340/550, 340/541, 545.6, 657, 506
See application file for complete search history.

(56) References Cited

U.S. PATENT DOCUMENTS

| | | | | |
|---|---|---|---|---|
| 6,755,050 | B2 * | 6/2004 | Lindskog | 66/170 |
| 7,211,783 | B2 * | 5/2007 | Beinhocker | 250/227.14 |
| 2006/0249664 | A1 * | 11/2006 | Beinhocker | 250/227.15 |
| 2009/0115607 | A1 * | 5/2009 | Beinhocker | 340/541 |

* cited by examiner

*Primary Examiner*—Phung Nguyen
(74) *Attorney, Agent, or Firm*—Greer, Burns & Crain, Ltd.

(57) ABSTRACT

The present invention relates to a safety lining, a safety alarming system provided with said safety lining, a logistic vessel provided with said safety alarming system, and a method for improving safety of the logistic vessel, said logistic vessel is provided with a safety alarming system, wherein said safety alarming system including: a plurality of safety linings disposed on the surface of said logistic vessel, each safety lining comprising a base, whose backside is fixed to the surface of the vessel through connecting devices; an electrically conductive unit disposed on said base and having terminals for electrical connections; wherein, the conductive units of a plurality of said safety linings are connected to an interfacing circuit through terminals to form a closed electrically conductive network, said closed conductive network has an equilibrium state for safety and a fluctuant state for unsafety; and an alarming unit connected to said interfacing circuit, which alarms when said conductive network is under fluctuant state. The invention can ensure a timely alarm when the logistic vessel is damaged, therefore improve the safety during the transportation.

19 Claims, 8 Drawing Sheets

SAFETY LINING, A SAFETY ALARMING SYSTEM PROVIDED WITH THE SAME, A LOGISTIC VESSEL WITH SAFETY ALARMING SYSTEM, AND A METHOD FOR IMPROVING SAFETY OF THE LOGISTIC VESSEL

FIELD OF THE INVENTION

The present invention relates to the logistic transportation field, and more particularly, to a safety lining, a safety alarming system provided with the same, a logistic vessel provided with said safety alarming system for improving the safety of the logistic transportation, and a method for improving safety of logistic vessel.

BACKGROUND OF THE INVENTION

With the development of international trade, a logistic vessel has become an important transportation tool and has been extensively adopted by many countries in the world. Recently, however, since many countries have enhanced their safety consciousness against risks and terrorist activities, they have put much higher demands on safety during transportation, one of which is that specific insurance measures should be taken for logistic vessels entering into homeland to ensure the safety of these vessels right after they are packaged at a starting station, i.e., they are not allowed to be opened illegally. Therefore, some countries even plan to require that logistic vessels entering into these countries be equipped with safety devices with electronic sensors to prevent the vessel from being opened illegally. Vessels equipped with these devices can go through the green channel into the homeland to save time. In contrary, vessels without safety devices should be inspected by customs when they arrive at the homeland port to prevent terrorist activities. However, it is difficult to know in time whether the vessel has been opened illegally or damaged during transportation and storage and to give an alarm in time. Previously, the assemblies of the vessel for opening, connecting and locking etc., have been judged by eyeballing whether the vessels have been broken into illegally, being replaced etc. have taken place. The above examination is quite difficult and labor intensive, and also sometimes will fail to find out.

Furthermore, most of the present safety measures are mainly improvements on mechanical structures, which cannot be used to timely monitor safety during transportation so as to take protection measures. These measures still have many disadvantages, for example, no alarm or records and can not prevent stealing when any peripheral part of a vessel is opened illegally. Although some safety devices have an electronic alarming function, they are not easy to install or cannot detect the safety of all peripherals of the vessel and need to be further improvements.

SUMMARY OF THE INVENTION

It is an object of the present invention to provide a safety lining, a safety alarming system provided with the same, a logistic vessel provided with said safety alarming system for monitoring container safety, and a method for improving safety of the logistic vessel, to solve the problems existing in the prior art that it is impossible to timely monitor the safety of the logistic vessel during the transportation and take efficient protection measures.

The object of the present invention is achieved by providing a safety lining, wherein said safety lining comprising a base and an electrically conductive unit disposed on said base, having terminals for electrical connections.

The safety lining further comprises a connecting device disposed on the backside of said base for fixing said safety lining.

The connecting device may be an adhesive film layer.

The connecting device may be a male-female belt buckle, one of said male belt buckle and female belt buckle is disposed on the backside of said base, and the other is disposed on the surface of a vessel.

The safety lining, wherein said base is a plastic film, in which is printed a circuit to form said electrically conductive unit.

The safety lining has a thickness between 0.1 mm and 10 mm.

To achieve the above-mentioned object, the present invention further provide a safety alarming system, comprising: a plurality of safety linings, each of which comprises a base and an electrically conductive unit disposed on said base, electrically connecting with an interfacing circuit through terminals, wherein a closed conductive network is formed by connecting the conductive units of a plurality of said safety linings to the interfacing circuit, having an equilibrium state for safety and a fluctuant state for unsafety; and an alarming unit, connected to said interfacing circuit, for alarming when said closed conductive network is in the fluctuant state.

The safety lining of the safety alarming system is divided into a plurality of small pieces which are connected respectively through connecting members.

The safety lining of the safety alarming system further comprises a connecting device disposed on the backside of said safety lining for fixing said safety lining.

The safety alarming system, wherein said connecting device is an adhesive film layer.

The safety alarming system, wherein said connecting device is a male-female belt buckle, one of said male belt buckle and female belt buckle is arranged on the backside of said base, the other is arranged on the surface of a vessel.

The safety alarming system, wherein that said base is a plastic film, in which is printed a circuit to form said conductive unit.

The safety alarming system, wherein said safety lining has a thickness between 0.1 mm and 10 mm.

The alarming unit comprises: an information terminal comprising: a reception module connected to said interfacing circuit for receiving data of said electrically conductive network; a CPU connected to said reception module for analyzing and processing said received data; and a memory connected to said CPU for data storage, and an alarming module connected to said CPU for alarming when said electrically conductive network is in the fluctuant state.

The information terminal of said alarming unit further comprise: a clock module connected to said CPU; and/or an interface unit connected to said CPU and an external module to provide ports for data exchange with external data.

To achieve the above-mentioned object, the present invention further provides a logistic vessel having a closed space, wherein the logistic vessel further comprises a safety alarming system, comprising: a plurality of safety linings encircling the surface of said logistic vessel, each safety lining comprising: a base, fixed onto the surface of the vessel through connecting devices provided on the backside thereof; and an electrically conductive unit disposed on said base, electrically connecting with an interfacing circuit through terminals, wherein a closed conductive network is formed by connecting the conductive units of a plurality of said safety linings to the interfacing circuit, having an equilibrium state for safety and a fluctuant state for unsafety, and an alarming unit connected to said interfacing circuit, for alarming when said closed conductive network is in the fluctuant state.

The safety lining of logistic vessel is divided into a plurality of small pieces which are connected respectively through connecting members.

The safety linings of the logistic vessel may be fixed onto the inner wall of the vessel.

The safety linings of the logistic vessel may be fixed onto the outer wall of the vessel.

The logistic vessel, wherein said connecting device may be an adhesive film layer.

The logistic vessel, wherein said connecting device may be a male-female belt buckle, one of said male belt buckle and female belt buckle is disposed on the backside of said base, and the other is disposed on the surface of the vessel.

The logistic vessel, wherein said base is a plastic film, in which is printed a circuit to form said conductive unit.

The logistic vessel, wherein the base of the safety lining disposed on the bearing surface of the vessel is made of floor adhesive, and said conductive unit is disposed inside said floor adhesive.

The above-mentioned logistic vessel, wherein said safety lining has a thickness between 0.1 mm and 10 mm.

The logistic vessel, wherein said alarming unit comprises: an information terminal comprising: a reception module connected to said interfacing circuit for receiving data of said electrically conductive network; a CPU connected to said reception module for analyzing and processing said received data; and a memory connected to said CPU for data storage, an alarming module connected to said CPU for alarming when said electrically conductive network is in the fluctuant state.

The logistic vessel, wherein the information terminal of said alarming unit further comprises: a clock module connected to said CPU; and/or an interface unit connected to said CPU and an external module to provide ports for data exchange with external data.

To achieve the above-mentioned object, the present invention further provides a method for improving safety of a logistic vessel provided with a closed space, wherein comprises the following steps: (1). providing a plurality of safety linings disposed on the inner or outer wall of the vessel, each of which comprise a base and an electrically conductive unit disposed on said base; the conductive units of a plurality of said safety linings are connected through electrical wires to form an closed conductive network, which is connected to the interfacing circuit; (2). providing an alarming unit connected to said interfacing circuit; and (3) alarming if the conductive network of said safety lining is damaged.

According to one aspect of the invention, a safety lining is disposed on the surface of the vessel to ensure that vessel damages can be timely detected and thus necessary safety measures can be taken.

The invention will be described in details by referring to preferred embodiments in which a container shown in the accompanying drawings is taken as an example of logistic vessel, however, these preferred embodiments should not be considered as the limitations to the invention.

DETAILED DESCRIPTION OF THE PREFERRED EMBODIMENT

The safety lining for a logistic vessel according to the present invention will be described by referring to a common container. However, it should be understood that the safety lining according to the present invention can also be used in other types of logistic vessels to monitor safety during transportation and thus improve transportation safety, which will not be considered as limitations to the invention.

Figure 1:
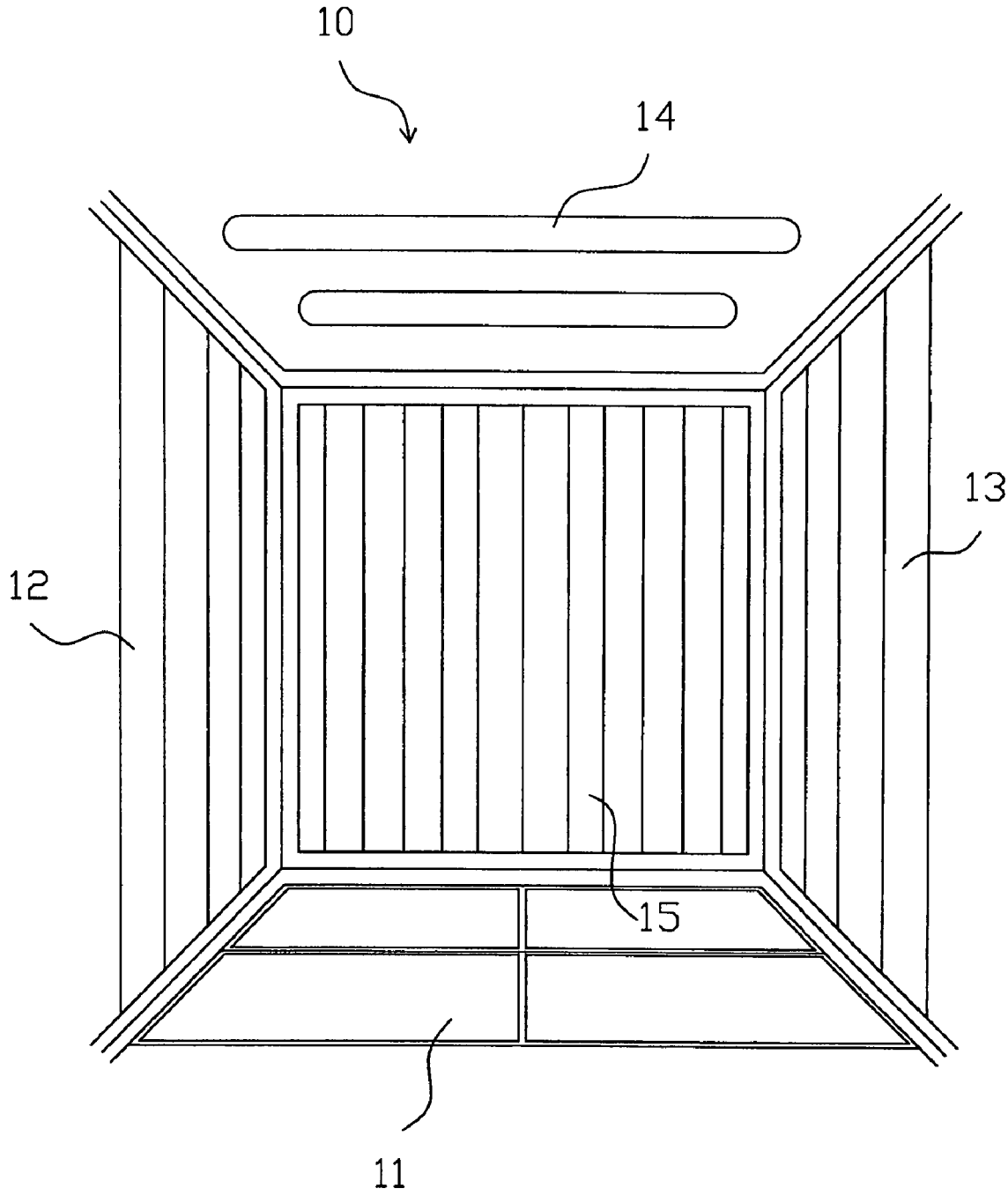
FIG. 1 is a perspective view showing the interior of a container without the safety lining according to the present invention.

As shown in FIG. 1, a common container 10 comprises a base plate 11, two side plates 12 and 13, a top plate 14, an end plate 15, and a container door (not shown).

Figure 2:
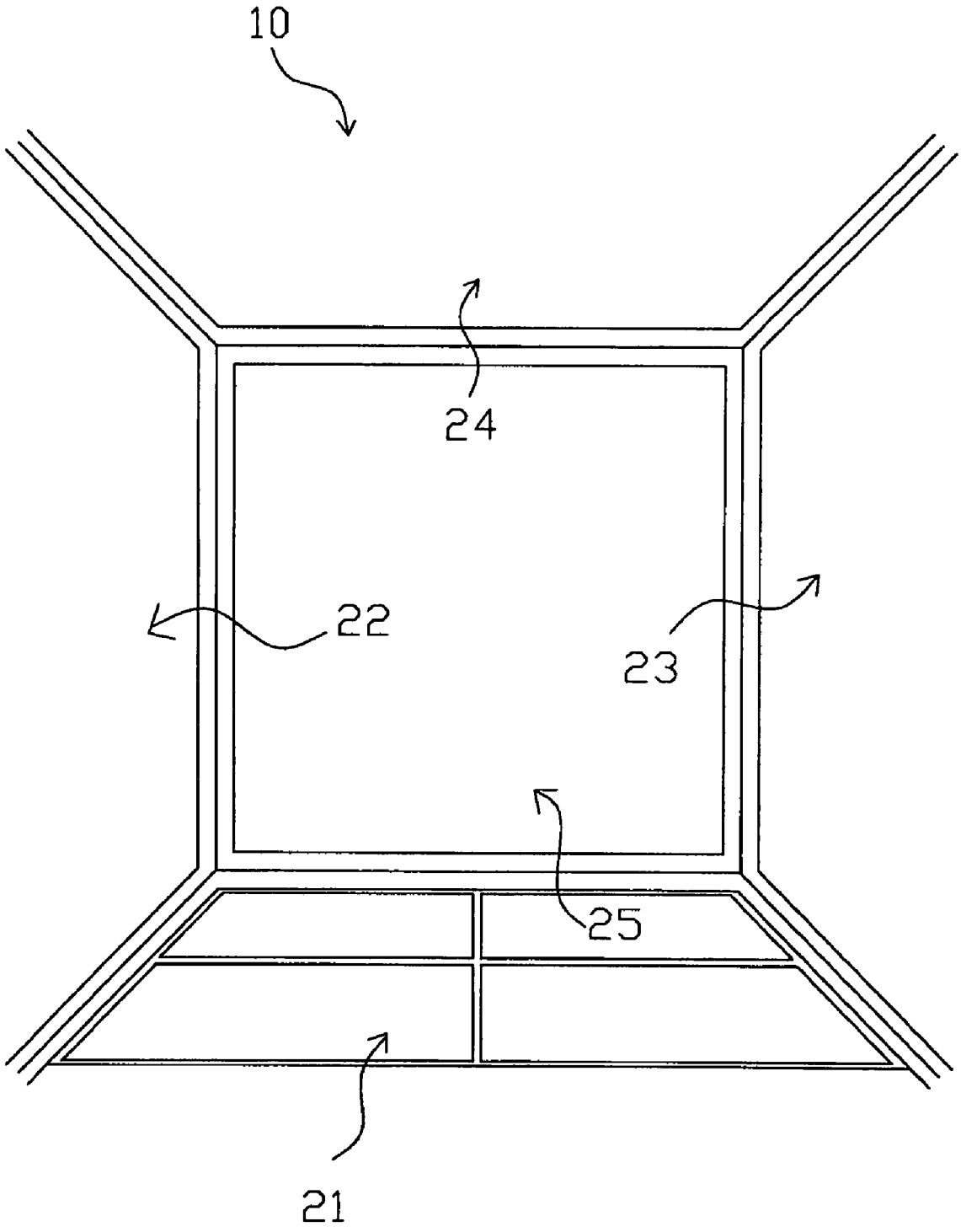
FIG. 2 is a perspective view showing the interior of a container provided with the safety lining according to the present invention.

As shown in FIG. 2, preferably, according to the present invention, safety linings 21-25 with electrically conductive units are disposed on the inner wall of the container 10. The safety linings 21-25 are closely attached to the inner wall of the container, and correspond to the bottom plate, side plates, top plate, end plate, and container door (not shown) respectively. The electrically conductive units of these safety linings are interconnected through conductive cables to form a closed hexahedral network, sealing thereby the six surfaces of the container in a form of an electrically conductive network. In addition, the electrically conductive network is connected to an alarming unit (not shown) through an interfacing circuit, said conductive network is in a state of electrical equilibrium in a safety situation, i.e., the voltage or current of the network does not change; and when the network on any surface of the container is damaged, the equilibrium state of the network will be broken, and accordingly the voltage or current will fluctuate, set off the alarming system.

According to the present invention, the safety lining may comprise a base, an electrically conductive unit disposed on the base, and a connecting device disposed on the backside of the base, through which the safety lining can be fixed onto the inner wall of the container. In addition, the safety lining can be either a integral piece corresponding to each large surface of the container such as the whole top plate or side plate, etc, or be divided into a plurality of standard small pieces (with conductive unit arranged inside).

Figure 3:
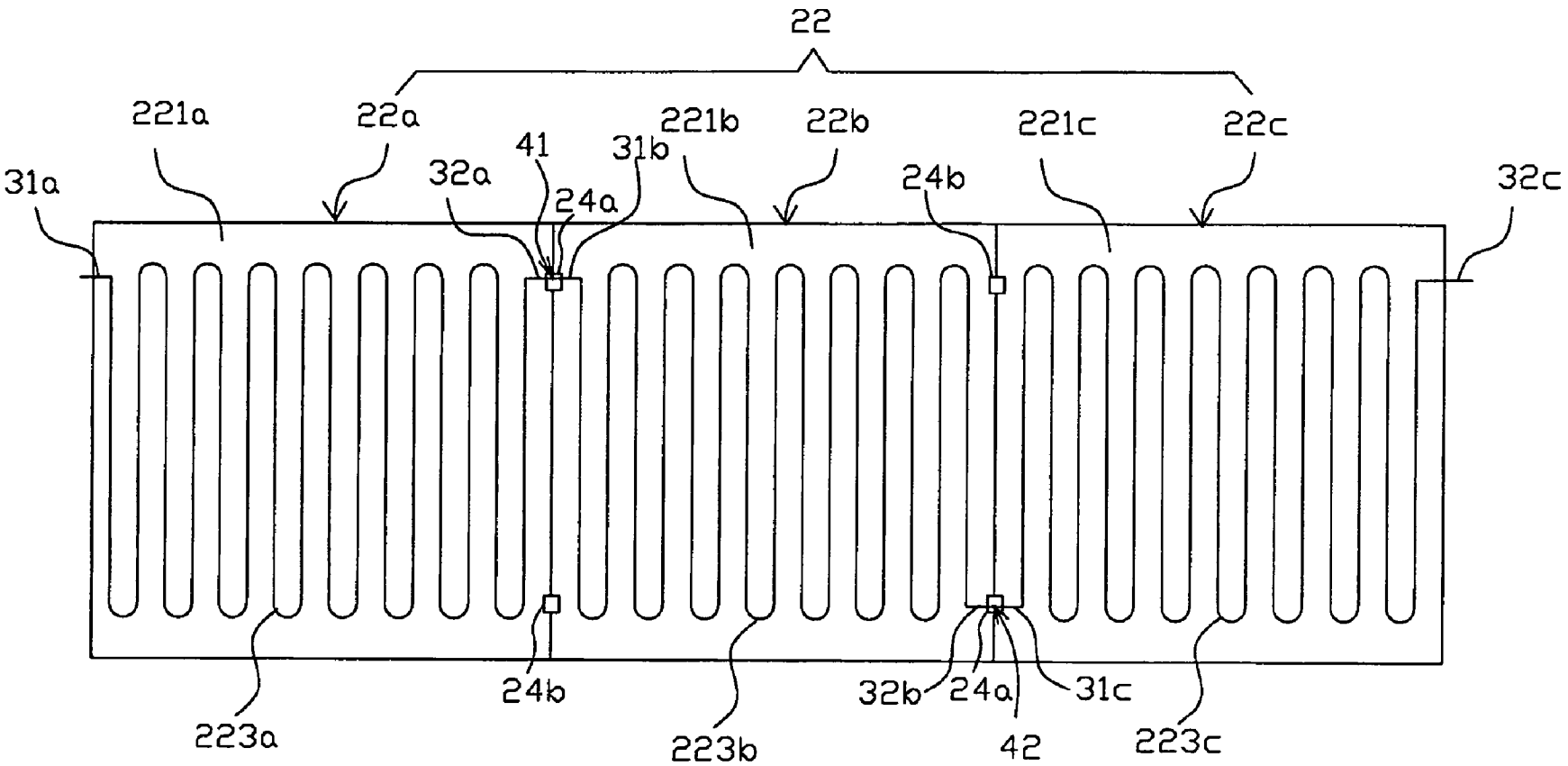
FIG. 3 is a front view of a safety lining disposed on the left side wall of a container according to the present invention, wherein said safety lining is formed by connecting a plurality of unit linings.

As is shown in FIG. 3, the structure of the safety lining according to the present invention will be described in detail by referring to the safety lining 22 disposed accordingly on the side plate 12 of the container. In the embodiment, the safety lining 22 is divided into a plurality of small pieces 22*a*, 22*b*, and 22*c*, the bases 221*a*, 221*b*, 221*c* of each small pieces 22*a*, 22*b*, 22*c* are interconnected through connecting members 24*a*, 24*b* to form the base of said safety lining 22, the conductive units 223*a*, 223*b*, 223*c* of each small pieces are interconnected through their connecting terminals to form the electrically conductive network of said safety lining 22, e.g., the terminal 32*a* of the small piece 22*a* is connected to the terminal 31*b* of the small piece 22*b* to form the network connecting point 41, the terminal 32*b* of the small piece 22*b* is connected to the terminal 31*c* of the small piece 22*c* to form the network connecting point 42, thus forming an integral piece of safety lining 22, the terminal 31*a* of said small piece 22*a* and the terminal 32*c* of said small piece 22*c* can be used as the connecting terminal for said safety lining 22 to electrically connect to other safety linings.

Preferably, in addition to connect the bases 221*a*, 221*b*, 221*c* of the small pieces 22*a*, 22*b*, 22*c*, the connecting members 24*a* also interconnect the conductive units 223*a*, 223*b* and 223*c* of the small pieces. Furthermore, said network 223*a*, 223*b*, 223*c* may be reticulate.

The method of forming a large piece of safety lining by a plurality of unit linings according to the present invention simplify the maintaining work, i.e. when some unit lining is damaged, just replace it with a new small piece and connect the network of new small piece.

Preferably, in the present invention, the safety lining may be made of an isolating material with predetermined strength, stiffness and flexibility such as canvas or polyester material, and the conductive unit disposed in the safety lining can be flexed together with said safety lining, therefore the safety lining can be fully attached to the surface of the container. Preferably, the thickness of the safety lining is between 0.1 mm and 10 mm.

Preferably, the safety lining disposed on the base plate may be made of adhesive plate inside which the electrically conductive unit is disposed. The glue plate can withstand the pressure generated by the fork truck when loading and unloading. Similarly, the safety lining disposed on the base plate may be divided into a plurality of small pieces, and the conductive unit of each of the small pieces are connected with each other, which are connected to the conductive unit of other surfaces of the container.

In addition, one surface of the safety linings disposed on side plate, end plate, top plate and container door of container may be made of material with high strength to resist against the shock by the cargo in the container.

Figure 4:
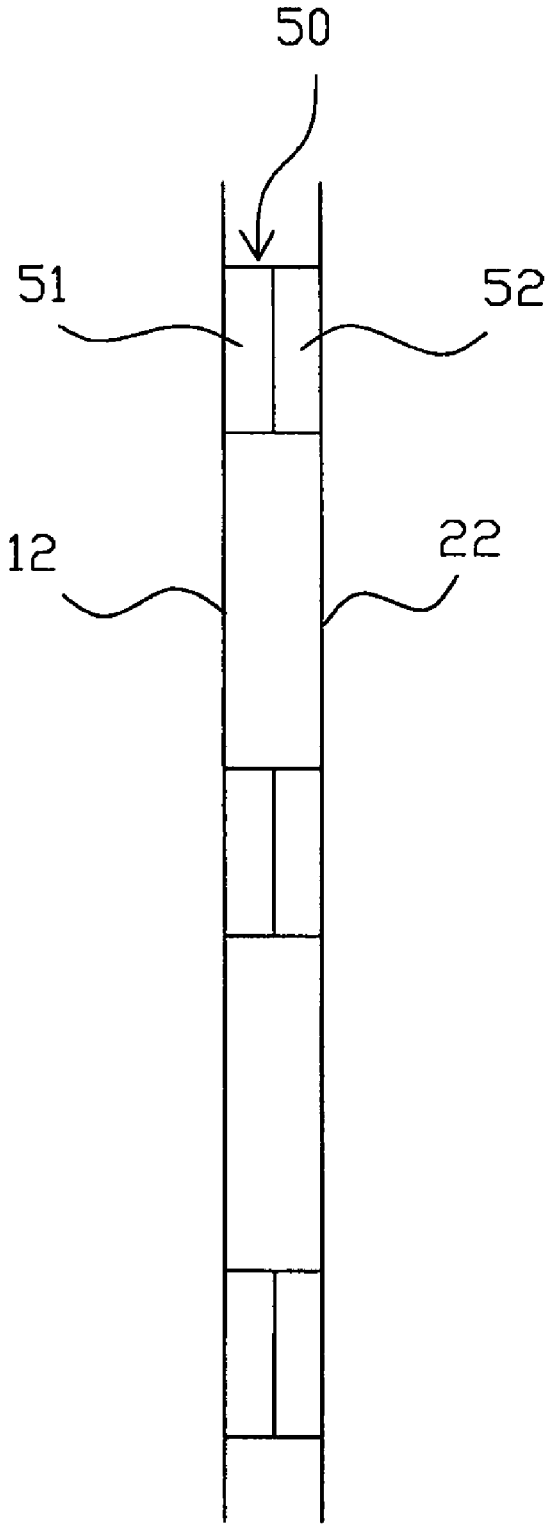
FIG. 4 is a side view showing the safety lining according to the present invention fixed on the inner wall of a container, wherein said safety lining buckles to the inner wall of the container through a male-female belt buckle.

As shown in FIG. 4, connecting device such as a male-female belt buckle 50 can be used to attach the safety lining 22 to the side plate 12 of the container.

Figure 5:
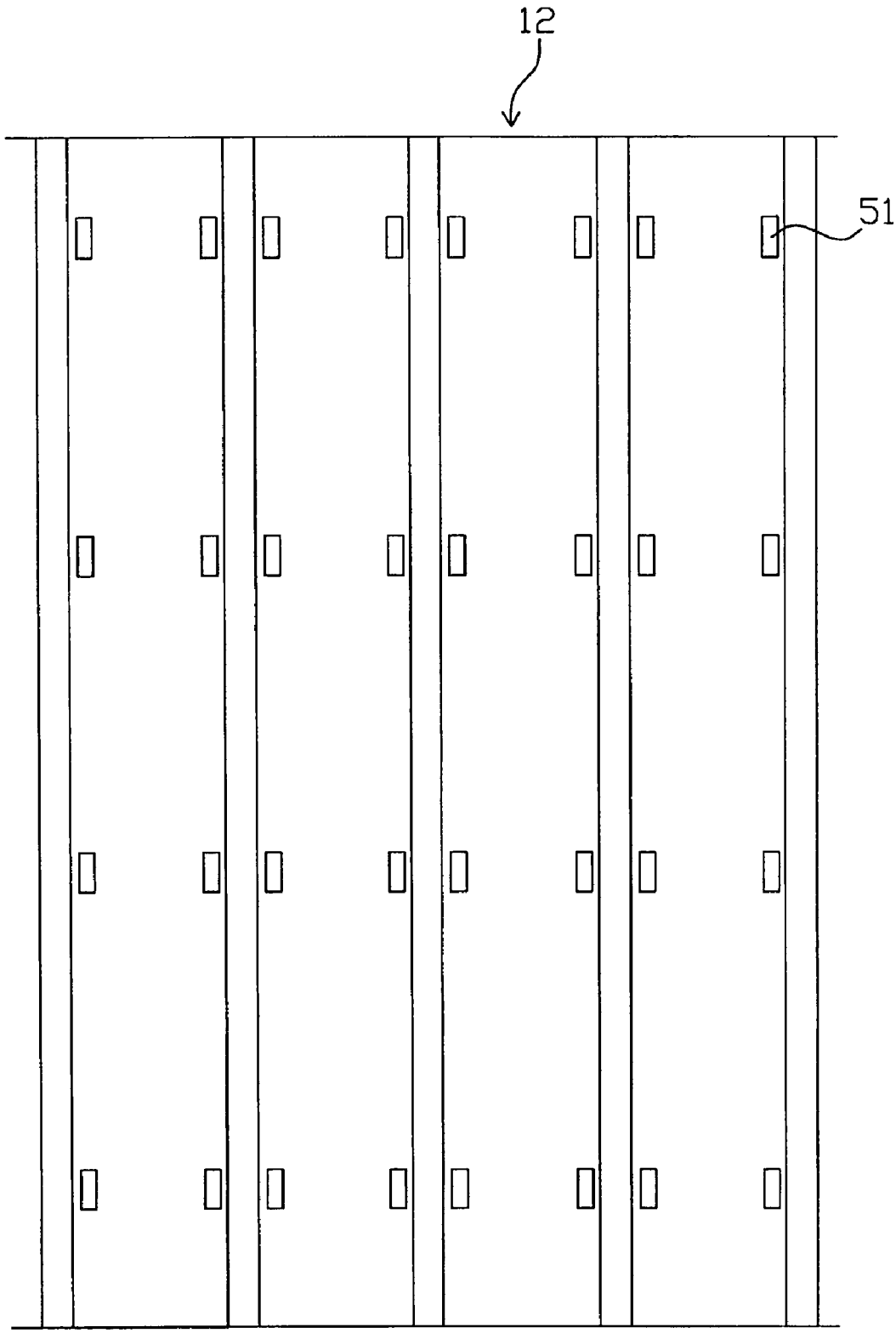
FIG. 5 is a schematic view showing the distribution of the male-female belt buckles on the inner wall of the container.
Figure 6:
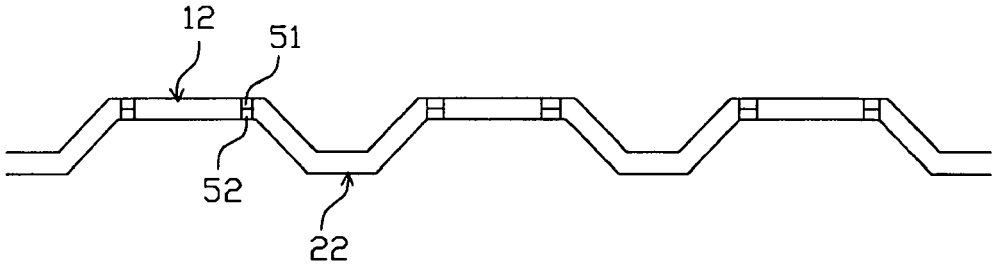
FIG. 6 is a top view of FIG. 4, wherein the female belt buckle is disposed on a trough plate of the inner wall of the container.

Referring now to FIGS. 5 and 6, when installing the safety lining 22, first the female belt buckles 51 (or male belt buckles 52) are uniformly fixed on the inner wall of the side plate 12, while the male belt buckles 52 (or female belt buckles 51) are disposed on the backside of the safety lining 22. Therefore the safety lining 22 can be fixed onto the inner wall of the side plate 12 through the buckling between the male and the female belt buckles.

The safety lining can be directly adhered to the inner wall of the container, i.e., an adhesive film layer can be disposed on the backside of the base of the safety lining, and thus the safety lining can be directly adhered to the inner wall of the container using the adhesive film layer. It should be understood that, in the present invention, means for connecting the safety lining to the inner wall of the container are not limited to use the above-mentioned connection device and adhesive, other means and materials are also available.

Also, it should be understood that the safety lining according to the present invention can be disposed on the outside of the container and can be used for the logistic vessels of other types.

Figure 7:
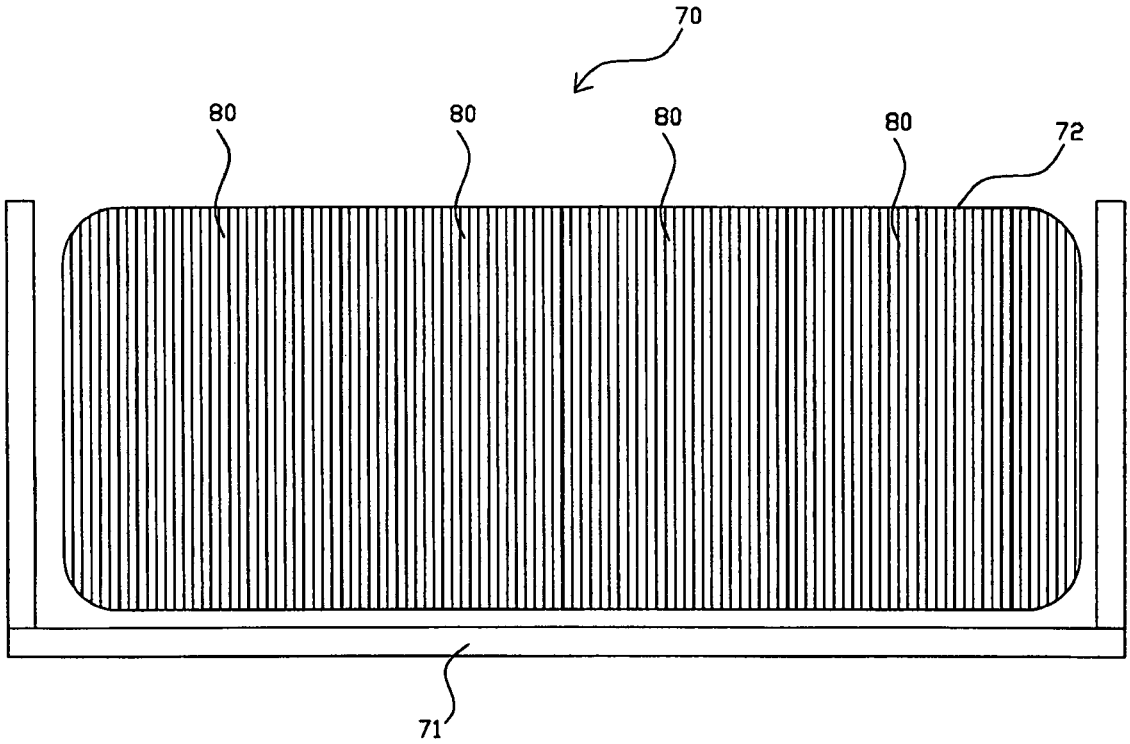
FIG. 7 is a side view of the safety lining according to the present invention disposed on a tank container.
Figure 8:
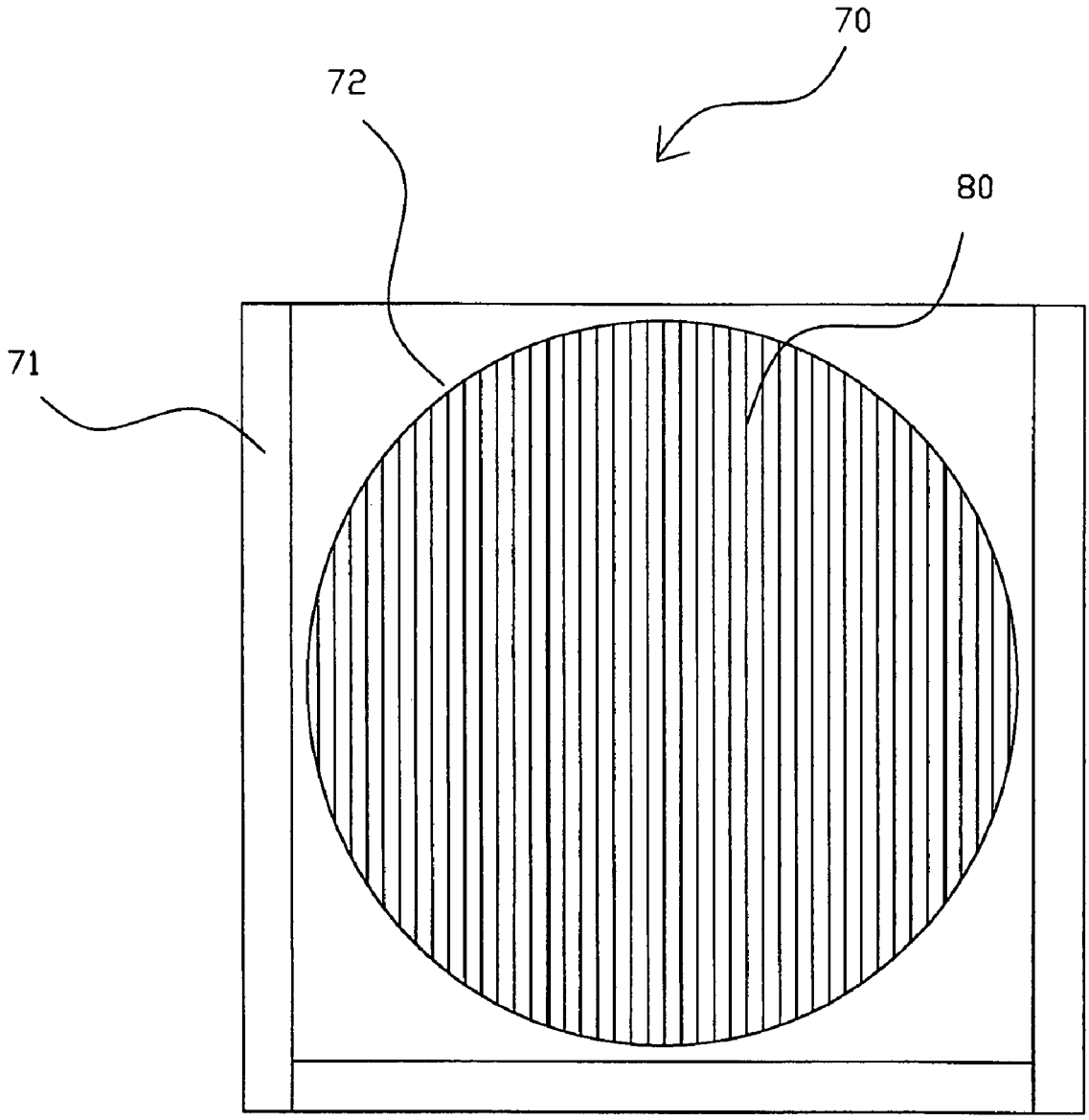
FIG. 8 is a side view of FIG. 7.

FIGS. 7 and 8 show an embodiment of applying the safety lining of the present invention to a tank container 70. In the embodiment, a plurality of the safety linings 80 encircle the outer surface of the tank 72 disposed in a frame 71. The electrically conductive units of a plurality of the safety linings 80 are interconnected, thus forming a closed conductive network surrounding the outer surface of the tank. If the surface of the tank is damaged, the voltage or current in the conductive network will change, thus the alarming system is triggered to alarm.

In the embodiment, preferably, the safety lining 80 may be made of a material in the form of thin film, such as a plastic film with the circuit printed therein, to achieve a closed contact between the safety lining and the tank. Connecting points are provided for safety linings 80 for electrical connection. And, an adhesive film layer is provided on one side of the safety lining which is adhered directly to the outer surface of the tank. The other side of the safety lining has a higher strength to resist shock.

More preferably, the plastic film provided with circuit also can be made into an outer protection layer (outer film), which directly covers the tank surface of a tank container or tank truck, to protect the tank. The alarming system will alarm when the tank is broken or damaged.

The structure and the operating principle of the safety alarming system constitute by the safety lining and the alarming unit according to the present invention will now be explained in details with reference to FIG. 9.

Figure 9:
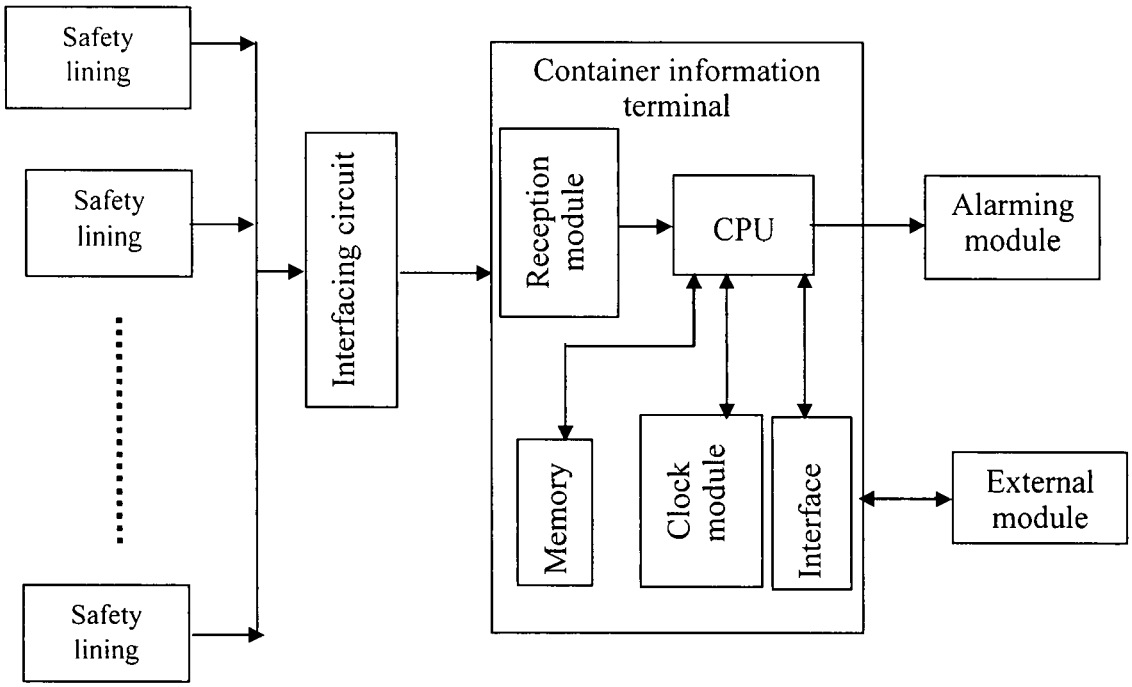
FIG. 9 is a structural view of a preferred embodiment of a safety alarming system according to the present invention.

As shown in FIG. 9, the safety lining according to the present invention is connected to the alarming unit through an interfacing circuit. The alarming unit can be an existing alarming unit. When the safety lining is damaged, the voltage or current in the electrically conductive network will change therefore the alarming system is triggered to alarm. Preferably, the alarming unit according to the present invention may comprise an information terminal and an alarming module. The information terminal comprises: a reception module connected to the interfacing circuit to receive data, i.e., voltage or current data of the conductive network, from the interfacing circuit; a CPU connected to the reception module for analyzing and processing the received data to determine whether to alarm or not, the CPU also executes data processing such as exchanging data with peripheral devices etc.; a memory connected to said CPU for data storage; a clock module connected to said CPU for generating clock signals to trigger the information terminal in a predetermined time period for data reception and processing; and an interface unit connected to said CPU and an external module to provide ports for data exchange with external data.

When the container is damaged, the electrically conductive network will be broken, therefore the voltage or current will be changed, which in turn will cause the CPU to trigger an alarm and record the changed information in real-time. The external module can read the recorded information through interface unit for analyzing and other purposes.

Figure 10:
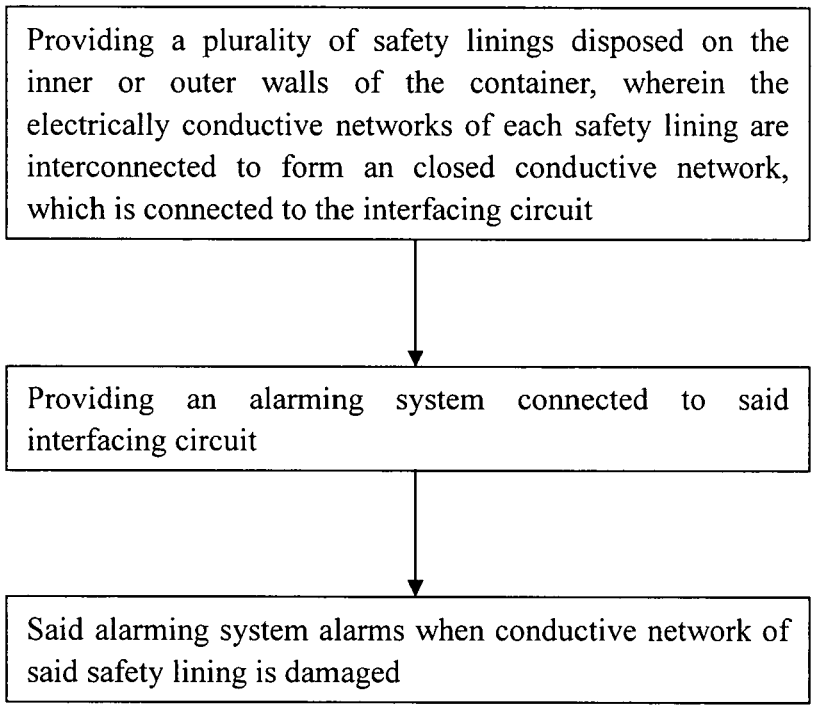
FIG. 10 is a schematic view showing a method for improving the container safety according to the present invention.

In particular, FIG. 10 further illustrates the method according to the present invention for improving container safety using the safety lining:

(1). providing a plurality of safety linings disposed on the inner or outer walls of the container, wherein the electrically conductive units of each safety lining are interconnected to form a closed conductive network, which is connected to the interfacing circuit;

(2). providing an alarming unit connected to the interfacing circuit; and (3). alarming if the conductive network is damaged.

In summary, by using the safety lining, the present invention can timely monitor the safety of the container during transportation, thus the protection measures can be taken when the container is damaged.

The descriptions herein are referred to the preferred embodiments but not limit to the embodied solution of the present invention. It will be apparent to those skilled in the art that various modifications and variations can be made in the embodiments of the present invention according to the design and spirit hereof. Thus, it is intended that the embodiments of the invention covers the modifications and variations of this invention provided they come within the scope of the appended claims and their equivalents.

What is claimed is:

1. A safety lining for a container including a base plate, two side plates, a top plate, an end plate and a door plate, wherein at least the side plates are made of corrugated plates, said safety lining comprising:

a base made of a flexible material and configured to conform to a surface of at least one of the corrugated plates to fully attach the base to the side plates by using at least one connecting device, each connecting device comprising a male belt buckle and a female belt buckle, wherein one of said male and female belt buckles is disposed on a backside of said base while the other of said male and female belt buckles is disposed at a trough of said at least one corrugated plate; and an electrically conductive unit disposed on said base, having terminals for electrical connections.

2. The safety lining according to claim 1, wherein said base is a plastic film, in which is printed a circuit to form said electrically conductive unit.

3. The safety lining according to claim 1, wherein said safety lining has a thickness between 0.1 mm and 10 mm.

4. A safety alarming system for a container that includes a base plate, two side plates, a top plate, an end plate and a door plate, wherein at least one of the side plates are made with corrugated plates, said safety alarming system comprising:

a plurality of safety linings, each comprising:

a base made of a flexible material so as to be fully attached to a surface of at least one of the corrugated plates by at least one connecting device, each connecting device comprising a male belt buckle and a female belt buckle, wherein one of said male and female belt buckles is disposed on a backside of said based and the other of said male and female belt buckles is disposed at a trough of the corrugated plate; and an electrically conductive unit disposed on said base, electrically connecting with an interfacing circuit through terminals, wherein a closed conductive network is formed by connecting the conductive units of said plurality of said safety linings to the interfacing circuit, having an equilibrium state for safety and a fluctuant state for unsafety; and an alarming unit, connected to said interfacing circuit, for alarming when said closed conductive network is in the fluctuant state.

5. The safety alarming system according to claim 4, wherein each safety lining is divided into a plurality of small pieces which are connected respectively through connecting members.

6. The safety alarming system according to claim 4, wherein said base is a plastic film, in which is printed a circuit to form said conductive unit.

7. The safety alarming system according to claim 4, wherein said safety lining has a thickness between 0.1 mm and 10 mm.

8. The safety alarming system according to claim 4, wherein said alarming unit comprises:

an information terminal, comprising:

a reception module connected to said interfacing circuit for receiving data of said electrically conductive network;

a CPU connected to said reception module for analyzing and processing said received data;

a memory connected to said CPU for data storage;

an alarming module connected to said CPU for alarming when said electrically conductive network body is in the fluctuant state.

9. The safety alarming system according to claim 8, wherein the information terminal of said alarming unit further comprise:

a clock module connected to said CPU; and/or an interface unit connected to said CPU and an external module to provide ports for data exchange with external data.

10. A logistic container comprising a base plate, two side plates, a top plate, an end plate and a door plate and provided with a closed space, wherein at least the side plates are made of corrugated plates, the container equipped with a safety alarming system comprising:

a plurality of safety linings encircling the surface of the logistic container, each safety lining comprising:

a base fixed onto an outside surface of the container through at least one connecting device, each connecting device comprising a male belt buckle and a female belt buckle, wherein one of said male and female belt buckles is disposed on a backside of said base while the other of said male and female belt buckles is disposed at a trough of the corrugated plate, the base including a flexible material so as to be fully attached to said at least one corrugated plate by the connecting device;

an electrically conductive unit disposed on said base, electrically connecting with an interfacing circuit through terminals, wherein a closed conductive network is formed by connecting the conductive units of a plurality of said safety linings to the interfacing circuit, having an equilibrium state for safety and a fluctuant sate for unsafety;

an alarming unit connected to said interfacing circuit, for alarming when said closed conductive network is in the fluctuant state.

11. The logistic container according to claim 10, wherein each safety lining is divided into a plurality of small pieces which are connected respectively through connecting members.

12. The logistic container according to claim 10, wherein a plurality of said safety linings are fixed onto the surface of the inner wall of the logistic container.

13. The logistic container according to claim 12, wherein the base of the safety lining disposed on the bearing surface of said logistic container is made of floor adhesive, and said conductive unit is disposed inside said floor adhesive.

14. The logistic container according to claim 10, wherein a plurality of said safety linings are fixed onto the surface of the outer wall of the logistic container.

15. The logistic container according to claim 10, wherein said base is a plastic film, in which is printed a circuit to form said conductive unit.

16. The logistic container according to claim 10, wherein said safety lining has a thickness between 0.1 mm and 10 mm.

17. The logistic container according to claim 10, wherein said alarming unit comprises:

an information terminal, comprising:

a reception module connected to said interfacing circuit for receiving the data of said electrically conductive network body;

a CPU connected to said reception module for analyzing and processing received data;

a memory connected to said CPU for data storage;

an alarming module connected to said CPU for alarming when said electrically conductive network body is in the fluctuant state.

18. The logistic container according to claim 17, wherein the information terminal of said alarming unit further comprises:

a clock module connected to said CPU; and/or an interface unit connected to said CPU and an external module to provide ports for data exchange with external data.

19. A method for improving safety of a logistic container comprising a base plate, two side plates, a top plate, an end plate and a door plate and provided with a closed space, wherein at least the side plates are made of corrugated plates, said method comprising the following steps:

providing a plurality of flexible safety linings on one of an inner wall and an outer wall of the logistic container by means of at least one connecting device such that the safety linings are fully attached to the corrugated plates of the side plates, each connecting device comprising a male belt buckle and a female belt buckle, one of said male and female belt buckles being disposed on a backside of said base while the other being disposed at a trough of the corrugated plate, each of said plurality of safety linings comprising a base and an electrically conductive unit disposed on said base; the conductive unit of a plurality of said safety linings are inter connected through electrical wires to form an closed conductive network, which is connected to the interfacing circuit;

providing an alarming unit connected to said interfacing circuit; and alarming if the conductive network is damaged.

* * * * *